US005954413A

United States Patent [19]

Brown

[11] Patent Number: 5,954,413

[45] Date of Patent: Sep. 21, 1999

[54] MODULAR STORAGE SYSTEM

[75] Inventor: Jerrold G. Brown, Medina, Ohio

[73] Assignee: Myers Industries, Inc., Akron, Ohio

[21] Appl. No.: 08/693,642

[22] Filed: Aug. 9, 1996

[51] Int. Cl.[6] ..... A47B 88/00

[52] U.S. Cl. ..... 312/328; 312/327; 312/294; 312/222; 292/145

[58] Field of Search ..... 312/327, 328, 312/294, 215, 222, 248, 275, 276, 271; 292/145, 152

[56] References Cited

U.S. PATENT DOCUMENTS

| | | | |
|---|---|---|---|
| 178,117 | 5/1876 | Crouch | 292/145 |
| 261,027 | 7/1882 | Nettleton | 312/328 |
| 327,502 | 9/1885 | Swan | 312/328 X |
| 335,921 | 2/1886 | Hardenbergh | 312/327 |
| 343,694 | 6/1886 | Bloomer | 312/327 |
| 379,166 | 3/1888 | Hunter | 312/327 |
| 509,479 | 11/1893 | Mayer . | |
| 717,484 | 12/1902 | Wilson | 312/327 |
| 728,054 | 5/1903 | Walker | 312/328 |
| 807,619 | 12/1905 | Horner | 312/294 |
| 812,343 | 2/1906 | Horner | 312/327 X |
| 888,513 | 5/1908 | Kurz | 312/294 |
| 892,830 | 7/1908 | Hobbs | 312/327 |
| 1,112,296 | 9/1914 | Kyle | 312/327 |
| 1,264,258 | 4/1918 | Bekkering | 312/327 |
| 1,595,263 | 8/1926 | Thornberry | 312/328 |
| 2,506,533 | 5/1950 | Winborne | 312/328 |
| 2,784,047 | 3/1957 | Wallance | 312/328 |
| 3,008,788 | 11/1961 | Garner | 312/328 X |
| 3,193,339 | 7/1965 | Cooper . | |
| 3,278,249 | 10/1966 | Howe . | |
| 3,942,851 | 3/1976 | Kaplan | 312/328 |
| 5,069,466 | 12/1991 | Propst | 312/328 X |
| 5,458,409 | 10/1995 | Sheng | 312/328 |

FOREIGN PATENT DOCUMENTS

| | | | |
|---|---|---|---|
| 74036 | 4/1952 | Denmark | 312/328 |
| 2544972 | 11/1984 | France | 312/328 |
| 850794 | 7/1952 | Germany | 312/328 |

OTHER PUBLICATIONS

MaidTuff Hardware Organizer advertisement 1994.

Akro–Mils new Quik–Tilt Storage Organizer advertisement (No Date Given).

*Primary Examiner*—Milton Nelson, Jr.
*Assistant Examiner*—James O. Hansen
*Attorney, Agent, or Firm*—Oldham & Oldham Co., L.P.A.

[57] ABSTRACT

Storage container for small articles. A storage container for small articles provides a stationary upright cabinet open at the front, one or more bins received in the cabinet and tiltable between an upright closed position and a forwardly tilting open position, and a latch secured to a front wall of the bin for locking the bin in the closed upright position. The cabinet includes a vertical back wall and vertical side walls which have lower edges that are adapted to rest on a horizontal supporting surface, and a bottom wall between these lower edges and directly above the supporting surface. Each bin includes a front wall and a bottom wall joined by a curved transitional surface, which has the curvature of a right circular cylinder. This curved transitional surface rolls along the upper surface of the bottom wall of the cabinet as a bin is moved from an open position to a closed position or vice versa. This rolling motion takes the place of a structure having a fixed pivot axis for supporting a bin. Projections extending downwardly from the bottom wall of the bin through correspondingly shaped openings in the bottom wall of the cabinet, prevent tilting beyond the predetermined limit, and also prevent undesired shifting of a bin as it moves, and further prevent accidental removal of a bin. The latch is slidable between a latching position and a retracted position, and is retained in either position by a keyless locking arrangement until a user manually slides the latch to the other position.

12 Claims, 6 Drawing Sheets

MODULAR STORAGE SYSTEM

BACKGROUND OF THE INVENTION

This invention relates to a modular storage system for small articles and a container therefor, in which the container comprises a generally upright open-front cabinet, and one or more tiltable storage bins received in the cabinet.

Storage bin devices which include a cabinet having one or more tiltable storage bins for receiving small articles are well known in the art. Representative patents which show such apparatus include U.S. Pat. Nos. 509,479; 812,343; 892,830; 1,112,296; 3,278,249; and 5,458,409. All of these patents show devices comprising a cabinet having a plurality of tiltable storage bins therein, wherein the storage bins tilt from an upright closed position to a forward open position.

Other patents illustrate somewhat different tilting arrangements for a tilting storage bin. These include U.S. Pat. Nos. 3,193,339 and 3,942,851.

A storage bin container apparatus may employ a latch for holding a storage bin or bins in closed position. Latches known in the prior art, for example include the latch shown in U.S. Pat. No. 5,458,409 (FIG. 1), and U.S. Pat. No. 3,278,249 (FIG. 9). The latch of Pat. No. 3,278,249 can be locked by means of a key. No latch locking means is shown in the latch of U.S. Pat. No. 5,458,409.

All of the storage bin devices shown in the patents listed above employ a fixed pivot axis about which a bin rotates. The pivot axis in each case extends laterally and horizontally. Various structures, as for example a rod (shown for example in U.S. Pat. No. 509,479), a crossbar (shown in U.S. Pat. Nos. 812,343 and 892,830), or pivot pins (shown for example in U.S. Pat. No. 3,278,249) have been proposed in the prior art.

A problem with storage bin devices employing a structure that defines a fixed pivot axis is that the center of gravity of a storage bin and its contents will change position as the bin is moved from closed to open position or vice versa. When a tilting bin is in its closed position, the center of gravity will typically lie rearwardly of the pivot axis. On the other hand, when the tilting bin is in its tilted or open position, the center of gravity of the bin and its contents will typically lie forwardly of the pivot axis. This places appreciable stress on the structure defining the pivot axis. Bins of presently known storage bin devices may tend to shift either forwardly or backwardly, or laterally, or to twist. Any of these shifts will place stress on the structure defining the pivot axis.

SUMMARY OF THE INVENTION

An object of this invention is to provide a storage container having at least one tiltable bin in which reliable rotating movement of the bin between an upright closed position and a forward open position is provided without the use of a structure which defines a fixed pivot axis.

A further object of this invention is to provide a tilting bin structure which has improved stability by virtue of a stabilizing structure.

A still further object of this invention is to provide a storage cabinet having one or more tilting bins, which includes an improved latch structure.

According to this invention there is provided a storage container which comprises a cabinet having an interior space and at least one tiltable bin received in this cabinet and tiltable between an essentially upright closed position and a forward open position. The cabinet is adapted to be supported on a supporting surface such as the floor of a building or a table top. Alternatively, the cabinet may be suspended from a vertical structure or wall. The cabinet includes an essentially horizontal bottom wall which is spaced above the supporting surface. The bin includes a front wall, a bottom wall and a curved transitional surface connecting the front wall and the bottom wall. The transitional surface is in contact with an upper surface of the bottom wall of the cabinet at all times. Contact is along a horizontal and laterally extending line of contact. As the bin rotates from a closed position to an open position or vice versa, the bin moves along the upper surface of the bottom wall in a rolling motion. As an aid to maintaining a bin in a desired path as it moves from closed to open position or vice versa, and to prevent accidental removal of a bin, this invention further provides at least one flange or projection which extends downwardly from the bottom wall of a bin through a correspondingly shaped opening in the bottom wall of the cabinet.

This invention according to a further aspect provides a bin which will stand upright on a level surface when removed from the cabinet.

This invention according to a still further aspect provides a keyless locking latch for a storage container, wherein a bin may be locked in the closed or upright position by means of a latch and wherein the latch in turn may be locked in either a bin-locking position or a bin-releasing position without the aid of a key.

DETAILED DESCRIPTION

Figure 1:
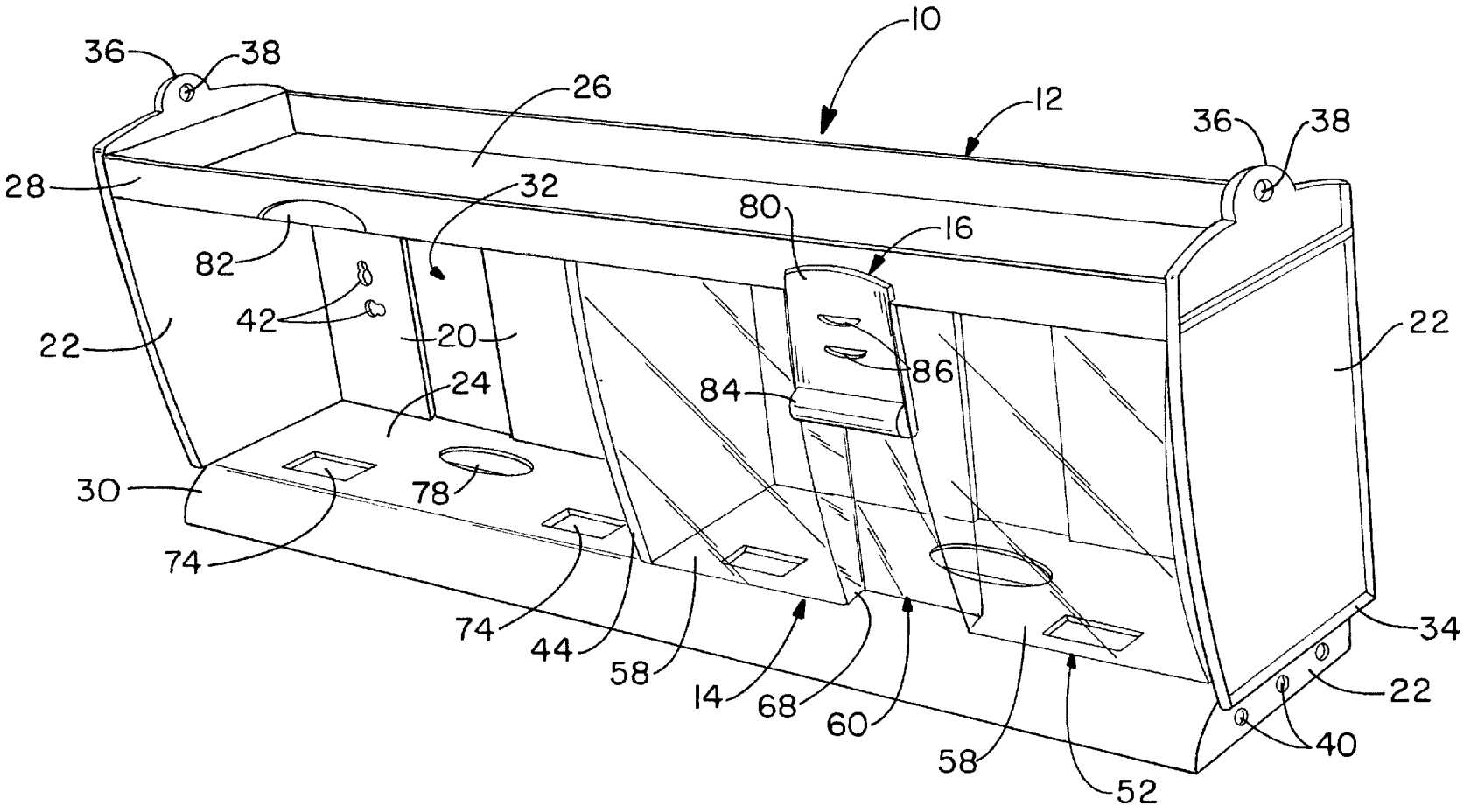
FIG. 1 is a perspective view of a storage container according to this invention, showing a tiltable bin in closed position and an empty space for a second tiltable bin.

This invention will now be described in detail with reference to the best mode and preferred embodiment thereof, as shown in the accompanying drawings.

Referring now to the drawings and especially to FIG. 1, 2, 3 and 4, a modular storage system according to this invention comprises one or more storage containers 10, which may be secured together, as for example using pins, and the like, as will be described in further detail subsequently.

Figure 2:
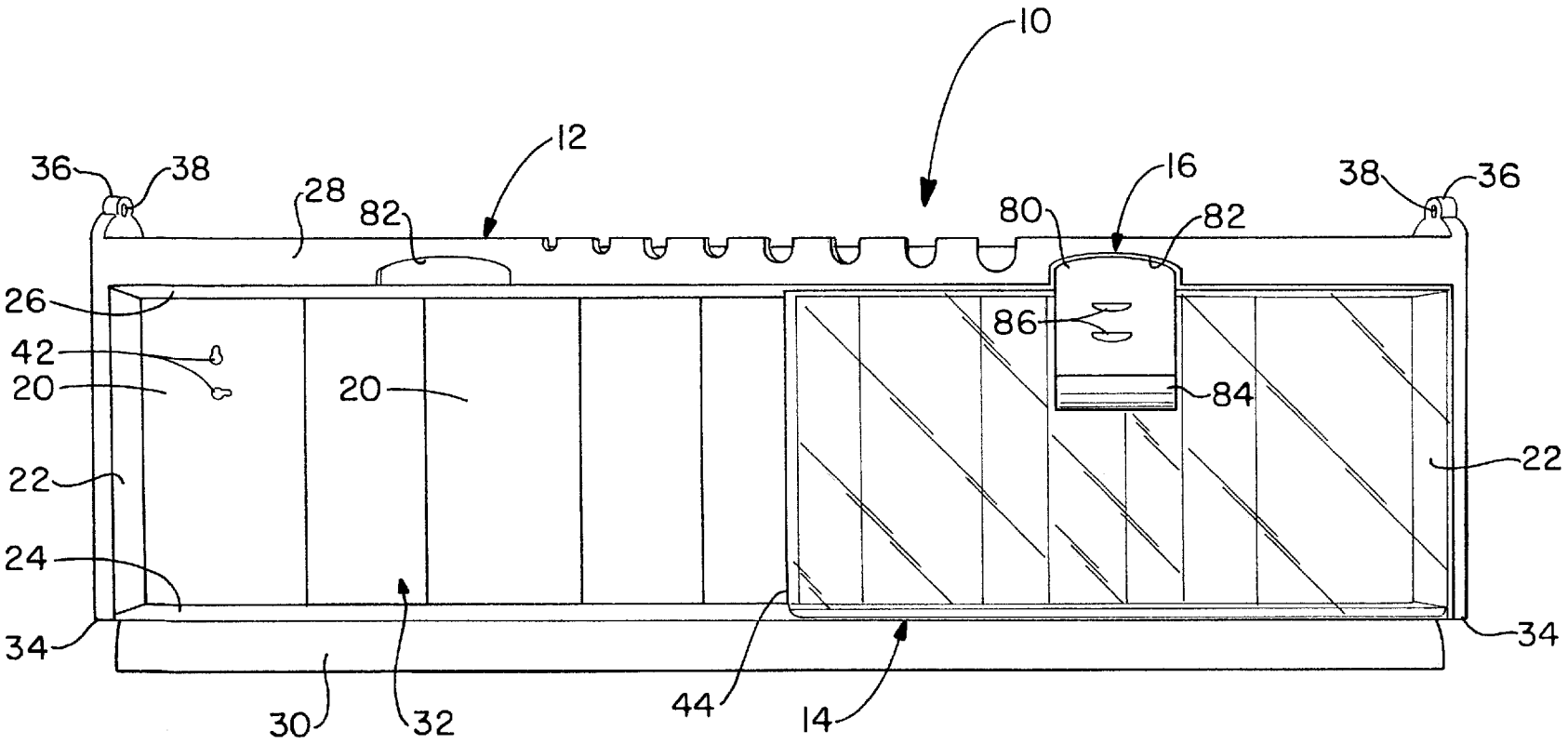
FIG. 2 is a front elevational view of the storage container shown in FIG. 1.
Figure 3:
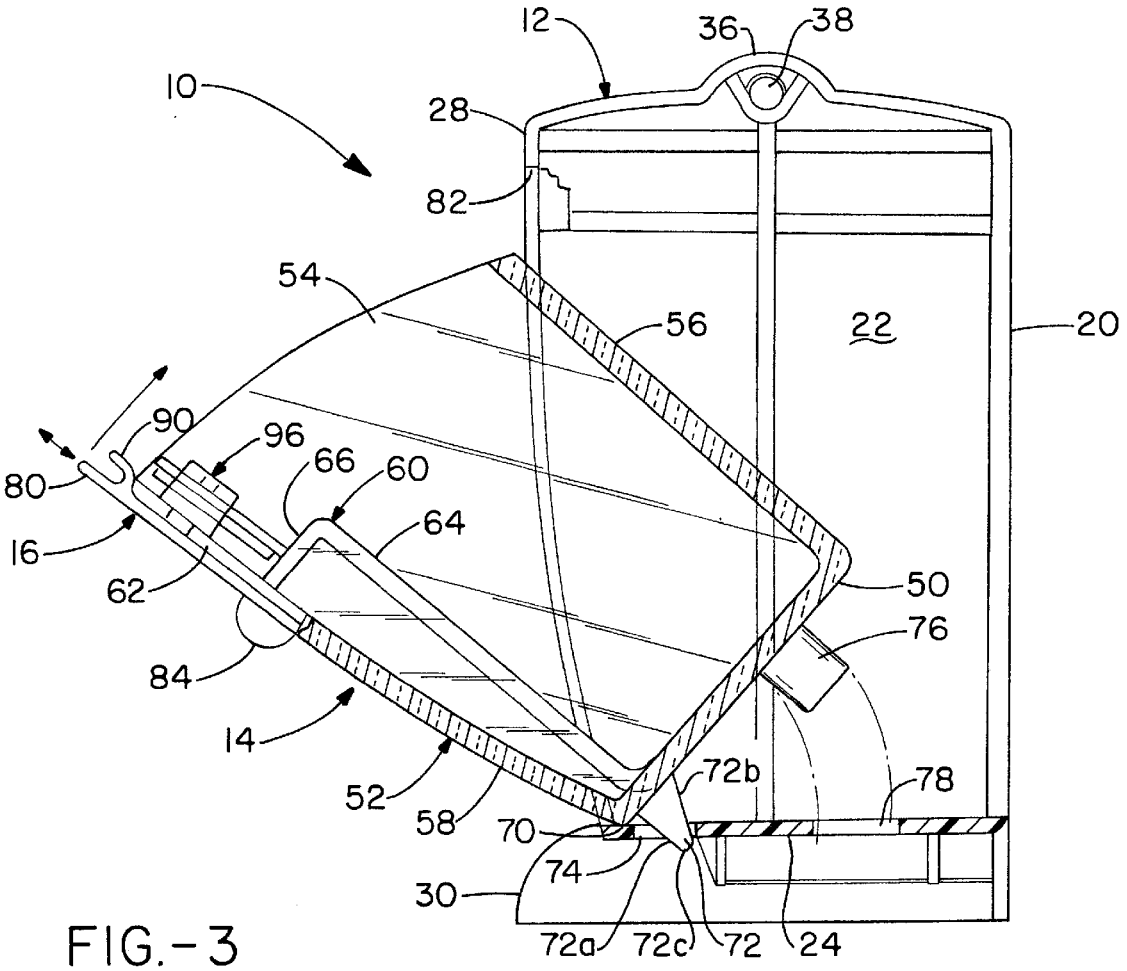
FIG. 3 is a side elevational view, shown partly in section, of the storage container of FIG. 1, with the tiltable bin in open position.
Figure 3A:
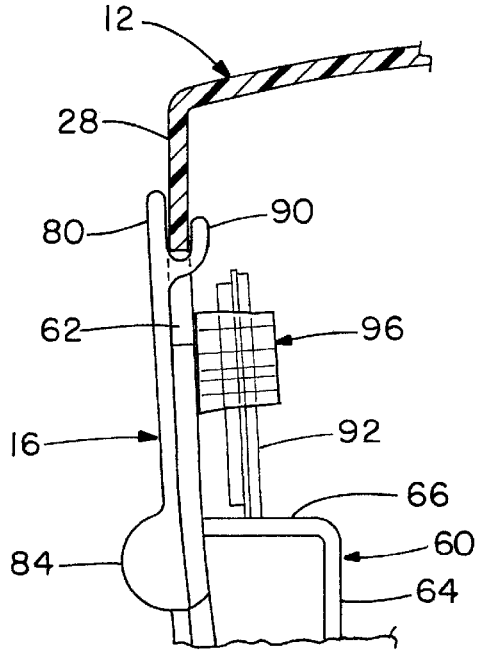
FIG. 3A is a fragmentary side view, partly in section, of a latch according to this invention, wherein the latch is shown in enlarged scale in bin locking position.
Figure 4:
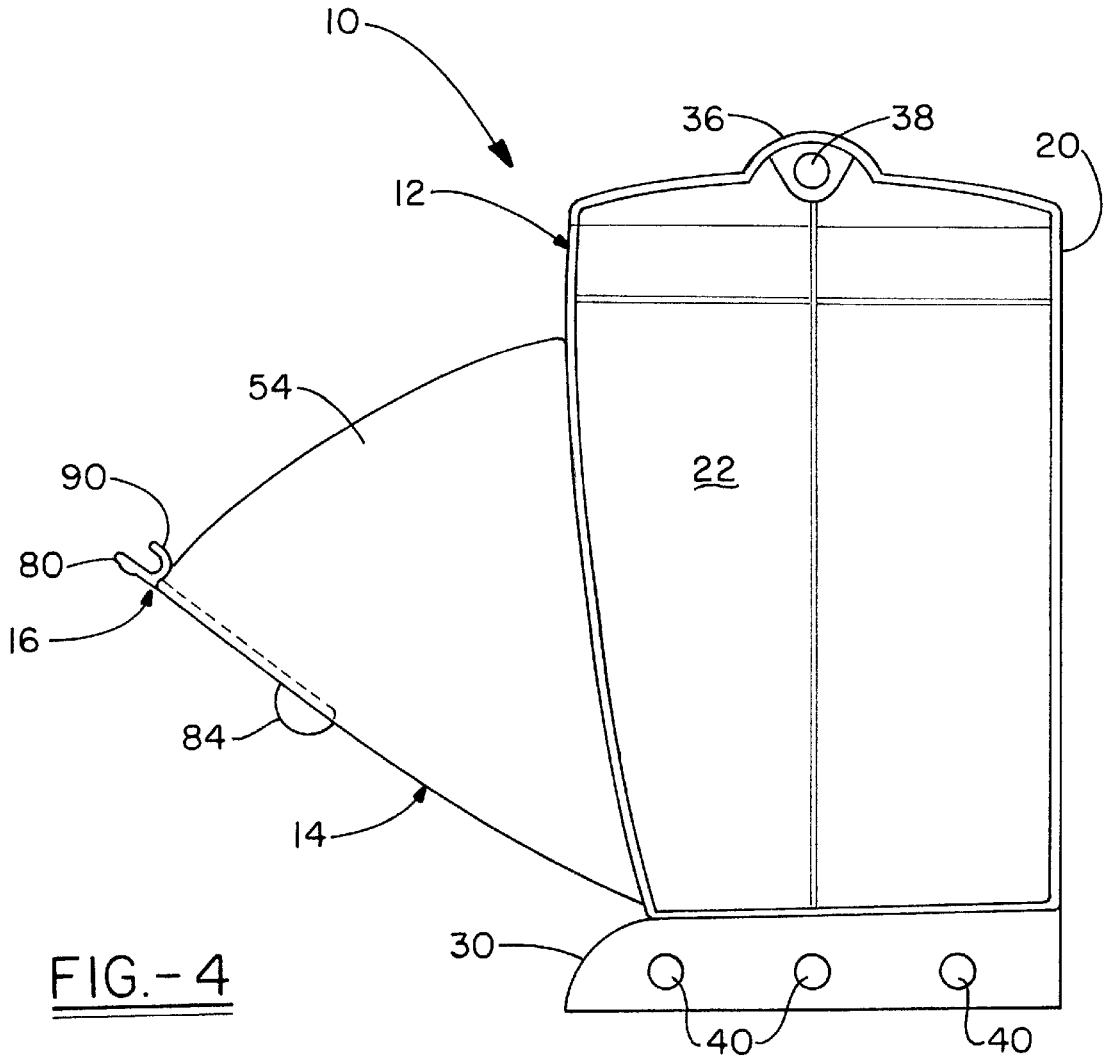
FIG. 4 is a side elevational view of a container according to this invention, showing a tiltable storage bin in open position.

A storage container 10 according to this invention comprises an upright open front cabinet 12 having an interior space which is adapted to receive at least one tiltable bin, at least one tiltable bin 14 received in the cabinet 12 and tiltable between an upright or closed position as shown in FIGS. 1 and 2 and a forwardly tilted or open position as shown in FIGS. 3 and 4, and a slidable latch 16 for retaining a bin 14 in open position.

Cabinet 12 and latch 16 are preferably made of a molded plastic. Currently, impact resistant polypropylene or polystyrene is preferred. Cabinet 12 and latch 16 are preferably opaque and are preferably of different, contrasting colors. This is useful so that a user can tell at a glance whether a bin 14 is open or closed, as will be described later. Bin 14 is preferably made of a transparent thermoplastic material, which will permit quick visual inspection of the bin so that a user can see the contents therein and tell whether the bin is full, partially full or empty. The drawings herein show bin 14 as being made of a transparent material.

Cabinet 12 comprises a vertically extending back wall 20, a pair of spaced vertically extending side walls 22 (which are left and right side walls), a horizontal bottom wall 24, and a horizontal top wall 26 which is spaced upwardly from the bottom wall 24. Cabinet 12 is open along its front. Accordingly, cabinet 12 further includes a horizontally and laterally extending vertical top strip or upper frame member 28, and a laterally extending bottom strip 30 which is in the shape of a quarter circle. It will be noted that bottom strip 30 lies entirely below the bottom wall or floor of the cabinet 12.

The back wall 20, side walls 22, bottom wall 24 and top wall 26 together define an interior space for receiving one or more tiltable bins 14. A preferred cabinet 12 provides space for a plurality of tiltable bins 14, and a specific cabinet 12 shown in the drawings provides for two such bins.

The back wall 20 and each of the side walls 22 has a lower edge and an upper edge. The respective lower edges are coplanar (thereby defining a lower edge of cabinet 12) and are adapted to rest on a level supporting surface such as a table top or floor of a building. It will be noted that the bottom wall 24 of cabinet 12 is above the lower edges of the back and side walls, and therefore spaced above the supporting surface. The reasons for this will be discussed later. Similarly, the top wall 26 lies below the top edges of back wall 20 and side walls 22.

Back wall 20 has a plurality of vertically extending openings 32 therein, each of which extends from the top wall 26 to the bottom wall 24, to provide access to the interior space of cabinet 12.

Each side wall 22 includes an ear 36 having a thru hole 38 therethrough along its top edge. Each side wall 22 further includes a row of thru holes 40 below the lower leg of flange 34 and just a short distance above the lower edge. Thru holes 38 and 40 are provided so that a plurality of like cabinets 12 can be secured together to form a modular arrangement.

A back panel 20 of cabinet 12 may include two sets of key hole openings 42 (FIGS. 1 and 2) which will permit the cabinet to be hung or mounted on a building wall or partition, or on a vertical frame.

Cabinet 12 further includes a vertical partition 44, which extends from bottom wall 24 to top wall 26, for dividing the interior space of the cabinet into a plurality of compartments, each of which is adapted to contain one tiltable bin 14. In the preferred embodiment shown, there is one such partition 44, which divides the interior space of cabinet 12 into two compartments.

Also as shown in FIGS. 1, 2, 3 and 4, and referring especially to FIG. 3, a tiltable bin 14 has an open top and comprises a bottom wall 50, a front wall 52, a pair of spaced side walls 54, and a rear wall 56.

The side walls 54 are vertical in any position of bin 14. Each side wall 54 has an arcuate top edge. Back wall 56 is vertical when bin 14 is in the upright or closed position, and is inclined at an oblique angle as shown in FIG. 3 when the bin 14 is in the tilted or open position. Similarly, bottom wall 50 is horizontal when the bin 14 is closed and is inclined at an oblique angle as shown in FIG. 3 when the bin is open.

Front wall 52 comprises a pair of spaced vertically extending and gently curved side portions 58, and a recessed center portion 60 therebetween. The side portions 58 are gently and convexly curved from top to bottom, the curvature being the same as that of the forward edges of side walls 22 of cabinet 12. The side portions 58 have no curvature from side to side. The curvature from top to bottom is provided so that the upper portion of bin 14 will be deeper than the lower portion just above bottom wall 50.

The center portion 60 of front wall 52 provides a flat surface for slidably mounting latch 16. This center portion 60 comprises a slightly recessed flat upper center portion 62 (which provides the mounting surface for latch 16), a more deeply recessed (and also flat) lower center portion 64, and a shelf 66 therebetween. The outermost ends of opening 94 serve as a lower limit stop for latch 16. Upper center portion 62 and lower center portion 64 have flat vertical surfaces, and shelf 66 has a horizontal surface, when the bin 14 is in its closed or upright position.

Recessing of the center portion 60 of front wall 52 provides a pair of spaced and facing vertical walls 68 between the center portion 60 and the flanking side portions 58 of the front wall. These spaced vertical walls 68 provide a guideway for guiding the sliding movements for latch 16.

Movement of bin 14 between a closed (or upright) position and an open (or tilted) position is accomplished by a rolling motion rather than a rotation about a fixed pivot axis. This is an important feature of this invention. To this end, preferably a curved transitional surface 70 connects front wall 58 and bottom wall 50 of bin 14. This transitional surface 70 has the radius of curvature of a right circular cylinder having a horizontal axis which extends from one side 58 to the other side of bin 14. This transitional surface 70 is in contact with the upper surface of bottom wall 24 of cabinet 12 in all positions of the bin 14. Contact is made along a line of contact (or line of tangency) which runs from one side 58 of the bin to the other. This rolling motion is similar to that of an automobile tire as it travels over a road surface. The location of this line of contact moves along both the transitional surface 70 of bin 14 and the upper surface of the bottom wall 24 of cabinet 12 as the bin moves in what is essentially a rotary motion from its closed position to its open position or vice versa. The instantaneous line of contact moves forwardly along the upper surface of cabinet bottom wall 20 toward the front edge thereof as bin 14 rotates toward its tilted or open position, and moves rearwardly (toward back wall 20) as the bin 14 moves toward its closed or upright position.

Figure 6:
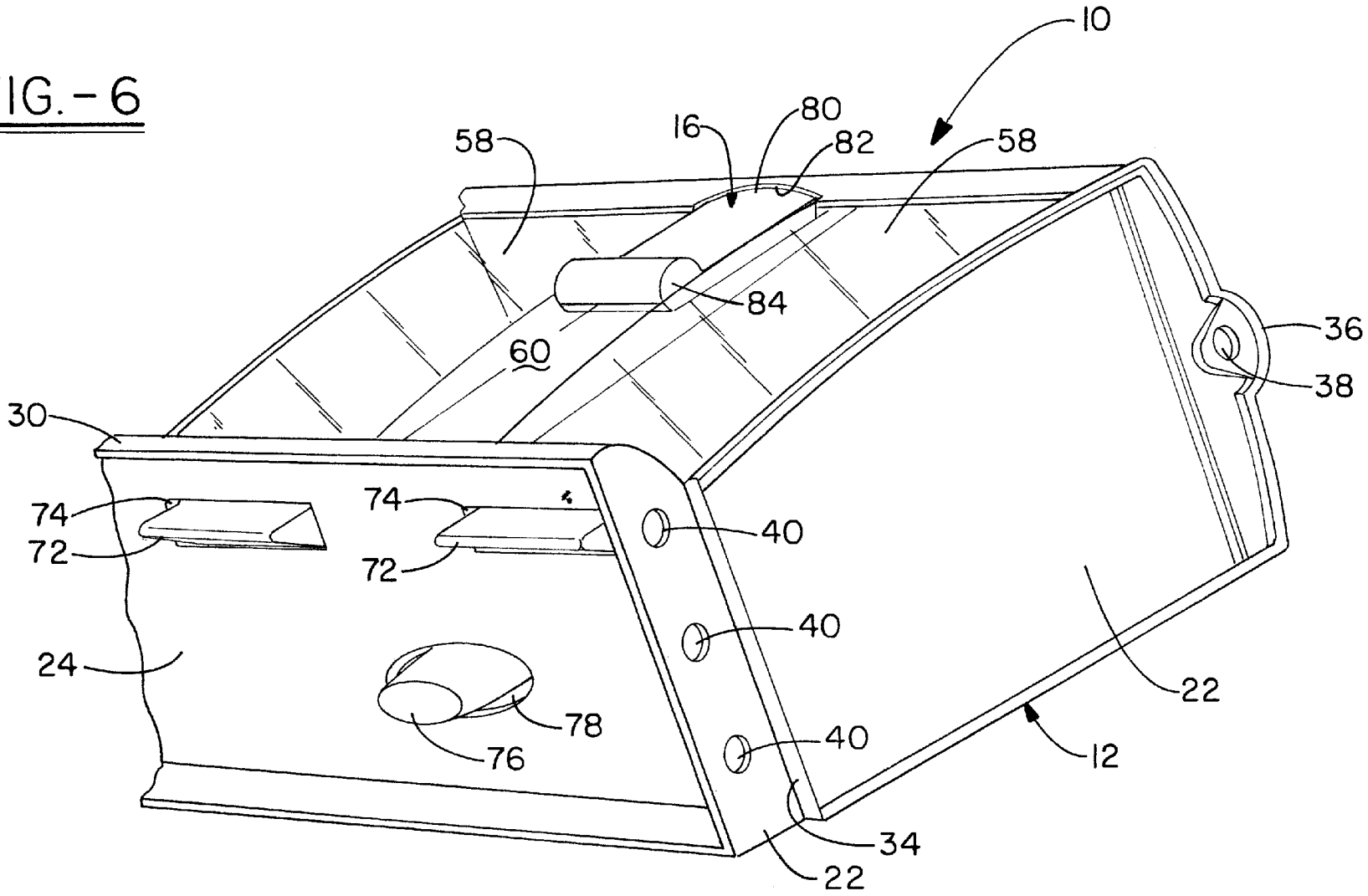
FIG. 6 is a fragmentary perspective view of a container according to this invention showing portions or a bottom wall, a front and a side wall of the container.

Retainer means are provided to confine bin 14 to a desired path as it moves between open and closed positions. The preferred retainer means, shown in FIG. 3, comprise a pair of laterally spaced projections or flanges 72 which extend downwardly from the bottom wall 50 of bin 14 through correspondingly shaped openings or holes 74 in the bottom wall 24 of cabinet 12. The purpose of these projections or flanges 72 is three-fold: to prevent accidental removal of bin 14 from cabinet 12, to limit the tilting movement of bin 14, and to confine bin 14 to a desired path as it rotates by preventing forward or backward movement (toward or away from cabinet back wall 20), or lateral movement, or twisting movement (i.e., rotary movement about a vertical axis). These objectives are achieved by providing wedge-shaped projections 72, each of which has a flat forward face 72*a* that is perpendicular to the bottom wall 50 of bin 14, and a flat rearward face 72*b* that intersects bin bottom wall 50 at an obtuse angle and a flat outer surface 72*c*. Faces 72*a* and 72*b* converge from a maximum distance apart at a base (where projection 72 is joined to bin bottom wall 50) to a minimum distance apart at outer edge surface 72*c*, which is remote from the base. These projections are long enough so that they extend through respective holes 74 in all positions of bin 14; note FIG. 3 in this regard. Holes 74 are rectangular and just wide enough and deep enough to receive respective projections 72 in all positions of bin 14 as it moves between the open and closed positions. As is apparent from FIG. 3, the rearward face 72*b* of a projection 72 will strike bin bottom wall 50 at a rearward edge of corresponding hole 74 when bin 14 reaches its limit of travel in the tilting direction. This both limits tilting movement of bin 14 and prevents accidental removal of the bin. Projections 72 and opening 74 are also shown in FIG. 6. Projections 72 and holes 74 are provided in a forward portion of bin bottom wall 50 and cabinet bottom wall 24 respectively, just behind the transitional surface 70 of bin 14 and the portion of cabinet bottom wall 24 which this transitional surface contacts as the bin 14 moves.

The cabinet bottom wall 24 is above the lower edges of back wall 20 and side walls 22 so that the projections can extend below the level of bottom wall 50. Bin 14 further includes one or more downwardly extending lugs or projections 76, which extend downwardly from the bottom wall 50 of bin 14, and a correspondingly shaped opening or hole (or holes) 78 in the bottom wall 24 of cabinet 12. The opening 78 is just slightly larger than the lug or projection 76 which it receives. Lug 76 has a flat bottom surface. The altitude or height of flanges 72 and lug(s) 76 (measured from bin bottom wall 50 to the respective outer or lower surfaces) are the same, so that a bin 14 can stand upright on a flat table top when removed from cabinet 12. The flanges 72 and lug (or lugs) 76 together provide a plurality of projections, extending downwardly from bottom wall 50, which enable a bin 14 to stand upright on a table top. Lug 76 and corresponding opening 78 also co-act to aid in confining bin 14 to the desired path of movement as bin 14 moves from open to closed position or vice versa, and in particular to prevent twisting movement of bin 14. The lug 76 and corresponding hole 78 also co-act to prevent undesired forward or backward movement, and undesired lateral movement of bin 14. Lug 76 and corresponding hole 78 may be of any desired shape, e.g., elliptical in shape as shown, the opening 78 being just slightly larger that the lug 76 at its base (where it joins bottom wall 50 or bin 14). It is preferred that lug 76 be either cylindrical (having a uniform cross sectional area over its entire length) or frusto-conical (tapering from the base to the outer end thereof).

It is apparent that the set of projection 72, the lug 76, and the corresponding opening 74 and 78, respectively, all cooperate to confine bin 14 to a desired path of movement and to prevent undesired shifting.

Latch 16 and its sliding movement will now be described with particular reference to FIGS. 1, 2, 3, 3A and 5.

Figure 5:
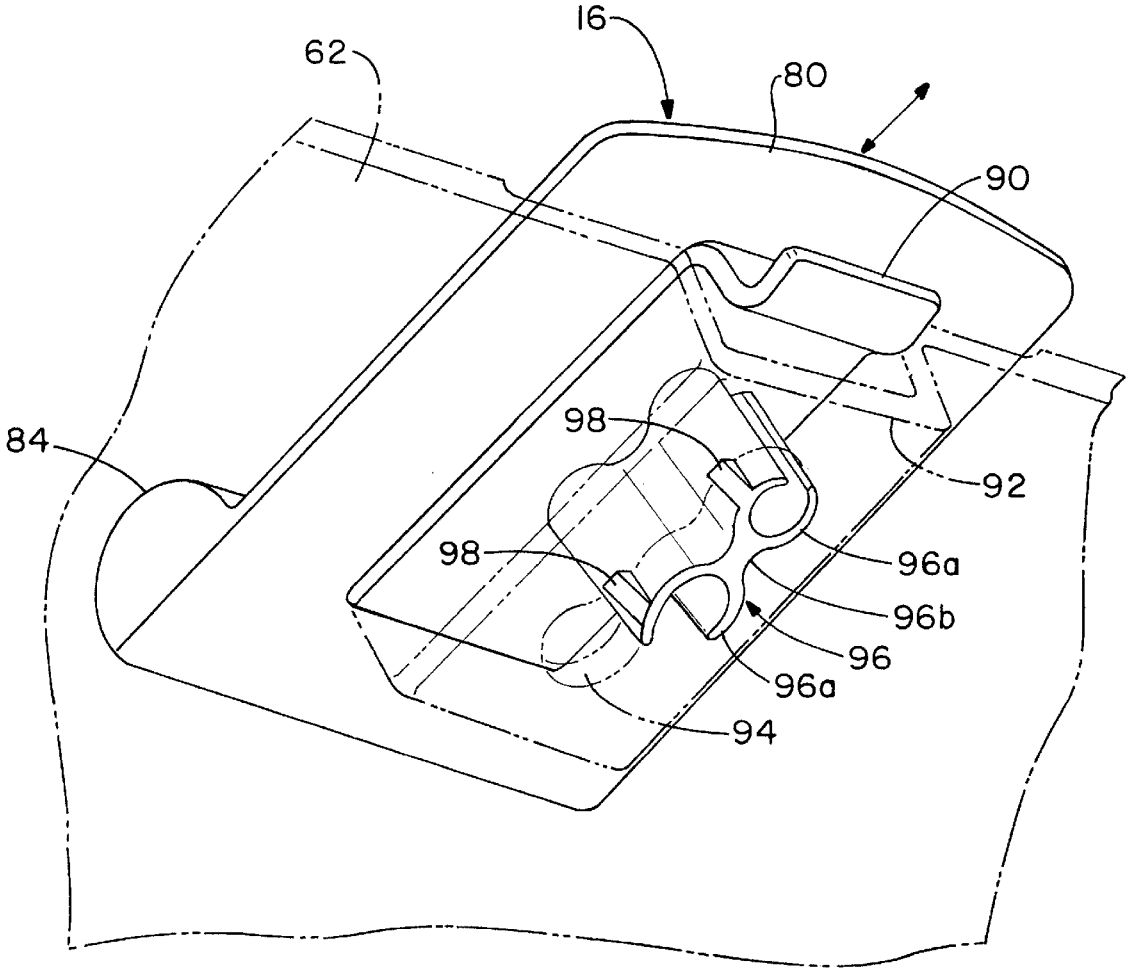
FIG. 5 is an enlarged fragmentary perspective view showing a latch of this invention as seen from the rear side of the latch.

Latch 16 has a thin, plate-like, essentially rectangular body 80, which has a front face seen in FIGS. 1 and 2 and a rear face seen in FIG. 5. The upper edge of body 80 may be slightly curved as shown in FIGS. 1 and 2. Correspondingly shaped recesses 82, one for each latch, are provided in top strip or upper frame member 28 of cabinet 12 for receiving an upper end portion of latch body 80 when latch 16 is in its extended or latching position as shown in FIGS. 1 and 2. A semi-circular enlargement 84 provided along the lower edge of the front face of latch body 80 and a pair of recessed horizontal grip members 86 on the front face of latch body 80 provide for manual actuation of latch 16, i.e., sliding the latch 16 vertically between an extended or latching position (shown in FIGS. 1, 2 and 3A) and a retracted or released position.

A tongue 90 is joined to the rear face of body 80 toward the upper edge thereof and extends outwardly and upwardly, forming with latch body 80 a forked or bifurcated upper end of latch 16, for gripping opposite sides of upper frame member 28 when the bin 14 is in upright or closed position and latch 16 is in extended position. Side wall 68 guides sliding movement of latch body 80. The top center portion 62 of the front wall of bin 14 has an inwardly extending channel 92, slightly wider than tongue 90, for guiding sliding movement of the tongue. Channel 92 has a slot 94, which comprises 3 vertically in-line circular portions of the same diameter, linked by two narrower neck portions. This slot receives a stem 96 which extends from the rear face of latch body 80 through slot 94. Stem 96 has two back-to-back C-shaped portions 96*a*, joined by a neck 96*b*. The C-shaped portions 96*a* are sized to pass through the neck portions of slot 94. Stem 96 is made of a flexible material, e.g., an elastomeric material which has memory, so that the end positions 96*a* can compress or bend in order to pass through the neck portions of slot 94 as latch 16 is moved from one position to the other, and then expand back to the normal position shown in FIG. 5. C-shaped portions 96*a* occupy the middle and lower circular portions of slot 94 when latch 16 is in its retracted or release position, and occupy the upper and middle circular portions of slot 94 when the latch 16 is in its extended or latching position. However, the C-shaped 96*a* are such diameter (except when compressed) that they frictionally engage the walls of circular portions of slot 94 when the latch 16 is in either retracted of extended position, preventing inadvertent sliding of latch 16 thus providing a keyless lock for retaining the latch in either the extended or the retracted position. Pinch members or detents 98, which are formed on outer edges of C-shaped portions 96*a* of system 96, normally spread out over an inner surface of channel 92 as shown in FIG. 5, thus securing the latch 16 to bin 14. This allows one to install a latch 16 on bin 14, since these pinch members will retract as one pushes the latch 16 into position. Once the latch is installed, these pinch members retain the latch in place, and one can remove the latch 16 from bin 14 only by manually pushing in these pinch members 98 inwardly and then pulling the latch 16 away from the front wall of bin 14.

The container 10 of this invention may be made as follows:

First, each of the principal parts, i.e., cabinet 12, bin 14 and latch 16, are formed separately by conventional plastic fabrication techniques, as for example by injection molding.

The subassembly of a latch 16 and a bin 14 is then formed by pressing the stem 96 of latch 16 through slot 94 in the channel section 92 of the front wall of bin 14 as previously described. Then a bin 14 with latch 16 attached is lowered into the open or tilted position shown in FIG. 3. Projection 72 on the bottom wall 50 of bin 14 goes into a slot 74 in the bottom wall 24 of cabinet 12; similarly, lug 76 goes into opening 78.

The bin 14 may then be moved to closed or upright position. The bin 14 then may be filled with small articles as desired and moved to closed or upright position. Latch 16 is retracted when bin 14 is moved to closed position, and then may be slid upwardly into latching position (shown for example in FIG. 3A) as previously described.

When a bin is in closed position and the latch 16 associated therewith is extended, as shown in FIG. 1, the contrasting colors of frame member 28 and latch 16 (assuming that contrasting colors are used) will be instantly observable.

To open a bin 14, a user simply slides a latch 16 downwardly and moves the bin to open or tilted position as shown in FIG. 3. The user may then remove articles as desired.

A bin may be removed simply by moving the bin to open position as shown in FIG. 3 and then lifting the bin out while it is in the orientation shown in FIG. 3.

Inadvertent removal of a bin 14 is prevented as previously described by the co-action of flange or projection 72 with its corresponding slotted opening 74.

Various types of small articles, as for example screws, nuts, bolts, and washers for hardware use, as well as thimbles, spools of thread and other miscellaneous small items for household use, can be stored in a bin 14 of this invention, although larger versions of this bin are contemplated. The range of articles for which a storage container of the type having a tilting bin is known in the art and will not be discussed at great length here.

Inadvertent shifting of a bin 14 during movement from one position to the other is prevented by co-action of projection 72 with its corresponding slotted opening 74, and/or by co-action of a lug 76 with its corresponding opening 78, as previously discussed.

A major advantage of a storage container according to this invention is that it does away with the usual pivoted axis and the attendant problems, such as stress on the axis structure as well as possible twisting, are done away with in accordance with this invention. The rolling movement of the curved transitional surface 70 of bin 14 along the upper surface of the bottom wall 24 of cabinet 12 provides a sturdy and reliable alternative which does away with the problems previously associated with bins which rotate about a fixed pivot axis.

While this invention has been described in detail with particular reference to the best modem preferred embodiment thereof, it shall be understood that such description is by way of illustration and not by way of limitation.

What is claimed is:

1. A storage container (10) comprising:

(a) a cabinet (12) having an open front and comprising a back wall (20), spaced vertically extending side walls (22), a bottom wall (24) and a top wall (26), said back wall, side walls, bottom wall and top wall together defining an interior space, said cabinet being adapted to be supported on a level supporting surface and said bottom wall being spaced above said supporting surface;

(b) at least one tiltable bin (14) received in said interior space and tiltable between a closed position and an open position, said bin having an open top and comprising a bottom wall (50), a front wall (52), a pair of spaced side walls (54) and a rear wall (56), said bin further comprising a curved transitional surface (70) between said front wall and said bottom wall and connecting said front wall and said bottom wall, said curved surface extending from one side wall to the other side wall of said bin, said curved surface being in contact with an upper surface of said bottom wall and moving along said upper surface of said bottom wall in a rolling motion as said bin moves from said closed position to said open position and vice versa, said bin further comprising at least one projection depending downwardly from said bottom wall of said bin and an opening in said bottom wall of said cabinet for receiving said at least one projection; and (c) a retainer means for limiting the extent of tilting movement of said bin from said cabinet and for confining said bin to a predetermined essentially arcuate path as it moves from said closed position to said open position.

2. A storage container according to claim 1, wherein said projection is essentially wedge shaped, having a forward face which is perpendicular to said bottom wall and rearward face which intersects said bottom wall at an obtuse angel, said forward and rearward faces converging toward an outer end of said projection.

3. A storage container according to claim 1, wherein at least a portion of said projection is received in said opening in all positions of said bin, thereby preventing accidental removal of said bin from said cabinet.

4. In an improved storage container comprising:

(a) a cabinet adapted to be supported on a supporting surface, said cabinet having an interior space and a bottom wall above said supporting surface; and (b) at least one bin having an open top side walls, a bottom wall and a back wall received in said cabinet and tiltable between an open position and a closed position;

the improvement comprising:

a plurality of projections extending downwardly from said bottom wall of said bin and enabling said bin to stand upright on a flat surface when removed from said cabinet, said projections being received in corresponding openings in said bottom wall of said cabinet at least one of said plurality of projections having a length sufficient to extend through said corresponding opening and below said bottom wall of said cabinet at all tiltable positions between and including said open position and said closed position.

5. A storage container (10) comprising:

(a) a cabinet (12) having an open front and comprising a back wall (20), spaced vertically extending side walls (22), a bottom wall (24) and a top wall (26), said back wall, side walls, bottom wall and top wall together defining an interior space, said cabinet being adapted to be supported on a level supporting surface and said bottom wall being spaced above said supporting surface;

(b) at least one tiltable bin (14) received in said interior space and tiltable between a closed position and an open position, said bin having an open top and comprising a bottom wall (50), a front wall (52), a pair of spaced side walls (54) and a rear wall (56), said bin having a surface in contact with said bottom surface of said cabinet as said bin moves from a closed position to an open position or vice versa; and (c) at least one lug (76) extending downwardly from said bottom wall of said bin at a location near the rear wall of the bin, and an opening (78) in the bottom wall of the cabinet for receiving said at least one lug.

6. A storage container according to claim 5, wherein said opening in said bottom wall of said cabinet for receiving said at least one lug is shaped so as to correspond with the shape of said at least one lug.

7. A storage container according to claim 5, said storage container further comprising a pair of projections (72) extending downwardly from said bottom wall of said bin at a location near said front wall of said bin and correspondingly shaped openings (74) in the bottom wall of said cabinet for receiving said plurality of projections, said at least one lug and said plurality of projections co-acting to enable said bin to stand upright on a flat surface when removed from said cabinet.

8. A storage container according to claim 7, wherein each projection of said plurality of projections is wedge shaped, having a forward face which is perpendicular to said bottom wall of said cabinet and a rearward face which intersects said bottom wall of said cabinet at an angle, said forward and rearward faces converging toward an outer end of each of said pair of projections.

9. A storage container according to claim 7 wherein at least a portion of said pair of projections is in contact with said correspondingly shaped openings at every position of said bin within said cabinet, thereby preventing accidental removal of said bin from said cabinet.

10. A storage container according to claim 5, said storage container further comprising a pair of projections (72) extending downwardly from said bottom wall of said bin and correspondingly shaped openings in the bottom wall of said cabinet, the configuration of said projections and said openings being such as to prevent accidental removal of said bin and to limit tilting movement of said bin, said lug and said projection co-acting to confine said bin to a desired path of movement as it moves from a closed position to an open position or vice versa, said lug and said projections further co-acting to enable said bin to stand upright on a flat surface when removed from said cabinet.

11. A storage container (10) comprising:

(a) a cabinet (12) having an open front and comprising a back wall (20), spaced vertically extending side walls (22), a bottom wall (24) and a top wall (26), said back wall, side walls, bottom wall and top wall together defining an interior space, said cabinet further comprising a laterally extending to stript (28) above said open front, said cabinet being adapted to be supported on a level supporting surface and said bottom wall being spaced above said supporting surface;

(b) at least one tiltable bin (14) received in said interior space and tiltable between a closed position and an open position, said bin having an open top and comprising a bottom wall (50), a front wall (52), a pair of spaced walls (54) and a rear wall (56), said bin having a curved transitional surface (70) between said front wall and said bottom wall and connecting said front wall and said bottom wall, said curved surface being in contact with an upper surface of said bottom wall and moving along said upper surface of said bottom wall in a rolling motion as said bin moves from a closed position to an open position or vice versa;

(c) a lug (76) extending downwardly from said bottom wall of said bin at a location near the back wall of the bin, and a corresponding opening (78) in the bottom wall of the cabinet for receiving said lug; and (d) a latch (16) slidably mounted on said front wall of said bin, and means (82) in said top strip of said cabinet for receiving an upper end portion of said latch, said latch and said top strip of said cabinet being of contrasting colors so that a user can tell at a glance whether said bin is open or closed.

12. A storage container according to claim 1 wherein said curved transitional surface has a curvature of a right circular cylinder and is in contact with said bottom wall along a line of tangency which extends from one side to the other of said bin.

* * * * *